US006648324B2

(12) United States Patent
Hoberock et al.

(10) Patent No.: US 6,648,324 B2
(45) Date of Patent: Nov. 18, 2003

(54) METHOD AND SYSTEM FOR AUTOMATICALLY SENSING THE SIZE OF PRINT MEDIUM IN A PRINTING DEVICE

(75) Inventors: Tim M. Hoberock, Boise, ID (US); Angela K. DiFronzo, Longmont, CO (US); John W. Huffman, Meridian, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 178 days.

(21) Appl. No.: 10/004,711

(22) Filed: Dec. 3, 2001

(65) Prior Publication Data

US 2003/0102620 A1 Jun. 5, 2003

(51) Int. Cl.[7] ..... B65H 1/00
(52) U.S. Cl. ..... 271/143; 271/171
(58) Field of Search ..... 271/145, 171; 73/579; 367/124

(56) References Cited

U.S. PATENT DOCUMENTS 5,574,551 A * 11/1996 Kazakoff ..... 399/45
5,689,759 A * 11/1997 Isemura et al. ..... 399/45
5,826,156 A * 10/1998 Natsume et al. ..... 399/389
5,940,106 A * 8/1999 Walker ..... 347/104

FOREIGN PATENT DOCUMENTS

JP 06183575 A * 7/1994 ..... B65H/1/00

* cited by examiner

*Primary Examiner*—Donald P. Walsh
*Assistant Examiner*—Kaitlin Joerger

(57) ABSTRACT

A resonance chamber is provided in a printing device, or in a print medium supply tray of the printing device, to determine the size of the print medium in the printing device. The supply of print medium and the resonance chamber are positioned so that the print medium covers a portion of the resonance chamber. An audio signal system then emits an audio signal to drive the resonance chamber. The frequency of the audio signal is varied until the natural resonance frequency of the chamber, as partially covered by the print medium, is discovered. The resonance frequency of the chamber will correspond to the amount of the chamber that is covered by the print medium and, hence, to the length (or width) of the print medium. In this way, the size of the print medium, whether standard or custom, can be determined.

24 Claims, 7 Drawing Sheets

METHOD AND SYSTEM FOR AUTOMATICALLY SENSING THE SIZE OF PRINT MEDIUM IN A PRINTING DEVICE

FIELD OF THE INVENTION

The present invention relates to field of printers and other printing devices that output a hard copy document on a print medium, e.g., paper. More specifically, the present invention relates to a method and system of automatically sensing the size of paper or other print medium stored in a supply tray or area within a hard copy printing device.

BACKGROUND OF THE INVENTION

Computers and computer networks are widely used by most all businesses to keep records, communicate, produce documents and otherwise manage information. Frequently, the work prepared on a computer is preferably rendered into hard copy form so that it can be stored or sent to another party. For this reason, printers and other printing devices that can render hard copy documents from computer data are critically important. Of equal importance are other printing devices that can be used to produce, copy or transmit hardcopy documents.

There are many different types of printers and printing devices. For example, types of printers include laser printers, inkjet printers, thermal printers, dot matrix printers and others. Other types of printing devices include, without limitation to, plotters, copiers, facsimile machines, multi-function peripherals, etc. As used hereafter and in the appended claims, the terms "printer" and "printing device" will be used to refer expansively to all printers and printing devices that output hard copy documents on some form of print medium, including, but not limited to, the examples given above.

In addition to the wide variety of printers and printing devices as described above, there is also a wide variety of print mediums on which printing devices can print hard copy documents. Examples of print media include, but are not limited to, paper, adhesive labels, cardstock, vinyl, transparencies, etc. Each of these media may be of a different size that the others. Additionally, each type of print media may have one or several standard sizes that are available. For example, paper can come in several standard sizes including letter, A4, legal and others.

During the production of hard copy documents, by printing, copying, etc., it is extremely helpful, and sometimes essential, to determine the size of the print medium. For example, the user may require a particular size of print medium and may need to change the type of print medium in the printing device in order to produce documents on the desired size of print medium. Alternatively, there may be two or more different types or sizes of print medium stored in the printing device. If the user knows what size the various supplies of print media in the printing device are, the user can specify which size or type of print medium should be used for a particular printing job.

In another example, the job being printed may be too large for the size of print medium available to the printing device. In such a case, the user can change the size of print medium in the printing device or, perhaps, the printing device can scale the images being printed to fit the available printing medium.

In all these cases, it is advantageous or essential to determine the size of the print medium or media available to the printing device. It would be preferable for the printing device to be able to automatically determine the size of the print medium or media stored in the printing device so that the size information can be conveyed to a user or automatically taken into account by the printing device in scaling, orienting or otherwise manipulating images being printed.

In the past, complex mechanical systems have been proposed as means for automatically detecting the size of a print medium stored in a printing device. These system typically depend on monitoring the movement of adjustable guides within, for example, a paper tray of the printing device and determining the size of the print medium based on the movement of such adjustable guides activating switches that correspond to the position of the adjustable guides when accommodating standard sizes of print media.

These systems, however, are complicated and require moving parts that are susceptible to damage and disrepair. Additionally, prior art systems are only suited for detecting standard print medium sizes.

Consequently, there is a need in the art for an improved method and system of automatically detecting the size of a print medium in a printing device. Preferably, such an improved system would not rely on complex mechanical linkages and would be able to detect any size of print medium, whether a standard or custom size.

SUMMARY OF THE INVENTION

The present invention is directed to a system for automatically sensing a size of print medium available to a printing device. In one preferred embodiment, a system according to the principles of the present invention may include: a resonance chamber, a portion of which is open, wherein the open portion is partially covered by a supply of print medium; a sound emitting system for acoustically exciting the resonance chamber over a range of frequencies; a system for detecting a natural resonance frequency of the resonance chamber as partially covered by the supply of print medium; and a processor for determining a dimension of the print medium based on a relationship between the natural resonance frequency of the resonance chamber and the dimension of the print medium.

Preferably, the sound emitting system may include a speaker, and a variable oscillator driving the speaker over the range of frequencies. The sound emitting system may also include an amplifier for amplifying a signal from the variable oscillator to the speaker, and a current supply for supplying current to the amplifier.

The system for detecting the natural resonance frequency of the resonance chamber may include a current meter for monitoring the amount of current pulled from the current supply by the amplifier as the variable oscillator drives the speaker over the range of frequencies. In such a case the system for detecting the natural resonance frequency of the resonance chamber may include a processor which controls the oscillator to drive the speaker over the range of frequencies; receives an output signal from the current meter; and identifies the natural resonance frequency of the resonance chamber as a frequency at which the current meter signals a minimum of current being drawn by the amplifier.

Alternatively, the system for detecting the natural resonance frequency of the resonance chamber may include a transducer for monitoring the amplitude of sound waves excited in the resonance chamber by the sound emitting system. In this case the processor controls the oscillator to drive the speaker over the range of frequencies; the transducer sends an output signal to the processor that indicates to the processor when the amplitude reaches a peak; and the processor identifies the natural resonance frequency of the resonance chamber as a frequency at which the transducer signals the peak amplitude.

The present invention also encompasses methods of automatically sensing the size of print medium available to a printing device. As before, the method is preferably performed with a resonance chamber, which is open on a side that is partially covered by a supply of the print medium. Such a method may include the steps of detecting a natural resonance frequency of the resonance chamber as partially covered by the supply of print medium; and determining a dimension of the print medium based on a relationship between the natural resonance frequency of the resonance chamber and the dimension of the print medium.

The step of detecting the natural resonance frequency may be performed by acoustically exciting the resonance chamber over a range of input frequencies and then monitoring the amplitude of sound waves excited in the resonance chamber to identify an input frequency resulting in sound waves with a maximum amplitude. Alternatively, after acoustically exciting the resonance chamber, a method according to the present invention may involve monitoring current drawn by an acoustic system acoustically exciting the resonance chamber to identify an input frequency with a minimum current requirement.

The present invention may also be incorporated in a printing device, such as a copier or printer. The printing device may also include a supply tray for holding the supply of print medium.

The resonance chamber may be formed in the supply tray or, alternatively, in the feeder area of the printing device. If the resonance chamber is formed in the supply tray, the tray may further include an electrical interface between the supply tray and the printing device to connect electrical components of either the sound emitting system or the system for detecting the natural frequency of the resonance chamber which are also disposed in the supply tray.

Alternatively, if the resonance chamber is formed in the feeder, the supply tray may have a window in the bottom of the tray for allowing the supply of print medium to partially cover the resonance chamber formed in the feeder below the supply tray.

BRIEF DESCRIPTION OF THE DRAWINGS

The accompanying drawings illustrate preferred embodiments of the present invention and are a part of the specification. Together with the following description, the drawings demonstrate and explain the principles of the present invention.

Throughout the drawings, identical elements are designated by identical reference numbers.

DETAILED DESCRIPTION OF THE PREFERRED EMBODIMENTS

The present invention uses a resonance chamber that is provided in a printing device, or in a print medium supply tray of the printing device, to determine the size of the print medium in the printing device. The supply of print medium and the resonance chamber are positioned so that the print medium covers a portion of the resonance chamber. An audio signal system then emits an audio signal to drive the resonance chamber. The frequency of the audio signal is varied until the natural resonance frequency of the chamber, as partially covered by the print medium, is discovered. The resonance frequency of the chamber will correspond to the amount of the chamber that is covered by the print medium and, hence, to the length (or width) of the print medium. In this way, the size of the print medium, whether standard or custom, can be determined.

Any resonance chamber, i.e., a cavity in which sound can propagate, has a natural resonance frequency. The natural resonance frequency is the frequency at which sound waves propagating in the chamber will cause the chamber to resonate. In other words, it will require very little energy to create a standing wave in the resonance chamber at the chamber's natural resonance frequency and, if the chamber is consistently driven at its natural resonance frequency, the amplitude of the sound wave in the resonance chamber will increase and continue to increase.

The natural resonance frequency of a resonance chamber will depend on the dimensions of the chamber. Under the principles of the present invention, as will be explained in more detail below, the supply of print medium in a printing device is used to cover some of an otherwise open side of a resonance chamber. The dimensions of the resonance chamber and its characteristic resonance frequency will, in part, depend on what amount of the otherwise open side of the chamber is covered by the supply of print medium. Thus, there will be a correlation between the resonance frequency and the size or length of the print medium. By determining the resonance frequency, we can determine the length (or width) of the print medium that is covering up some of the resonance chamber.

Using the drawings, the preferred embodiments of the present invention will now be explained.

Figure 1:
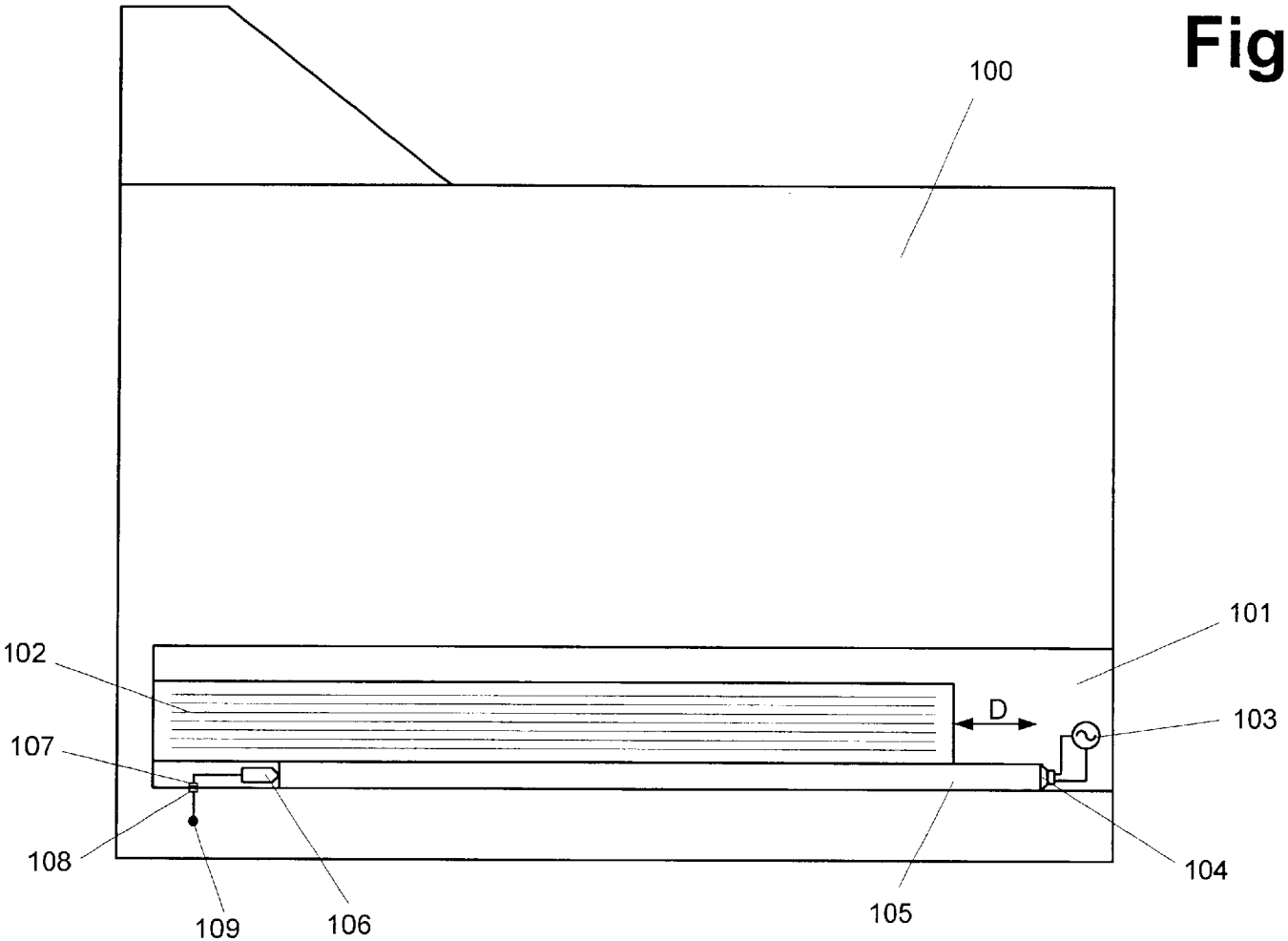
FIG. 1 is an illustration of a printer with a print medium size detection system according to the principles of the present invention.

FIG. 1 illustrates a first preferred embodiment of a printer (100) with an automatic print medium size detection system according to the principles of the present invention. While a generic printer (100) is illustrated, it will be understood that the principles of the invention explained with regard to FIG. 1 could, with equal ease, be incorporated in any type of printing device that uses a supply of print medium to output documents in hard copy form.

As shown in FIG. 1, a printer (100) according to a first preferred embodiment of the principles of the present invention may include a paper or print medium supply tray (101). Within the tray, a supply (102) of paper or other print medium is stored for use by the printer (100) outputting printed hardcopy documents.

Cut or formed into the bottom of the tray (101) is a resonance chamber (105). The resonance chamber (105) is open at the top, i.e., beneath the print medium supply (102). Consequently, as the supply (102) of print medium rests in the tray (101), the print medium (102) extends over and covers a portion of the resonance chamber (105). The portion of the resonance chamber (105) that extends beyond the length of the print medium (102) is illustrated by the two-headed arrow "D" in FIG. 1.

If the length of the print medium (102) changes, the distance (D) of uncovered resonance chamber (105) will increase or decrease. As explained above, this will alter the natural resonance frequency of the resonance chamber (105).

An audio signal emitting system (103, 104) is operatively coupled to the resonance chamber (105). This system includes, for example, a speaker (104) and a variable oscillator (103) that drives the speaker (104) over a range of audio frequencies.

When it is necessary to determine the length of the print medium (102), the oscillator (103) is driven over a range of audio frequencies that will include the possible natural resonance frequencies for the resonance chamber (105) as partially covered by the supply (102) of print medium.

An audio detection system is also operatively coupled to the resonance chamber (105). This system may include, a microphone (106) or other transducer for measuring the amplitude of the sound waves in the resonance chamber (105).

The signal from this transducer (106) is output to an electrode (107) in the supply tray (101). The electrode (107) in the supply tray (101) can be physically or operatively connected with a second electrode (108) located in the feeder area of the printer (100) when the tray (101) is inserted in the feeder. In this way, the output of the transducer (106) is transferred in to the printer (100).

Figure 3:
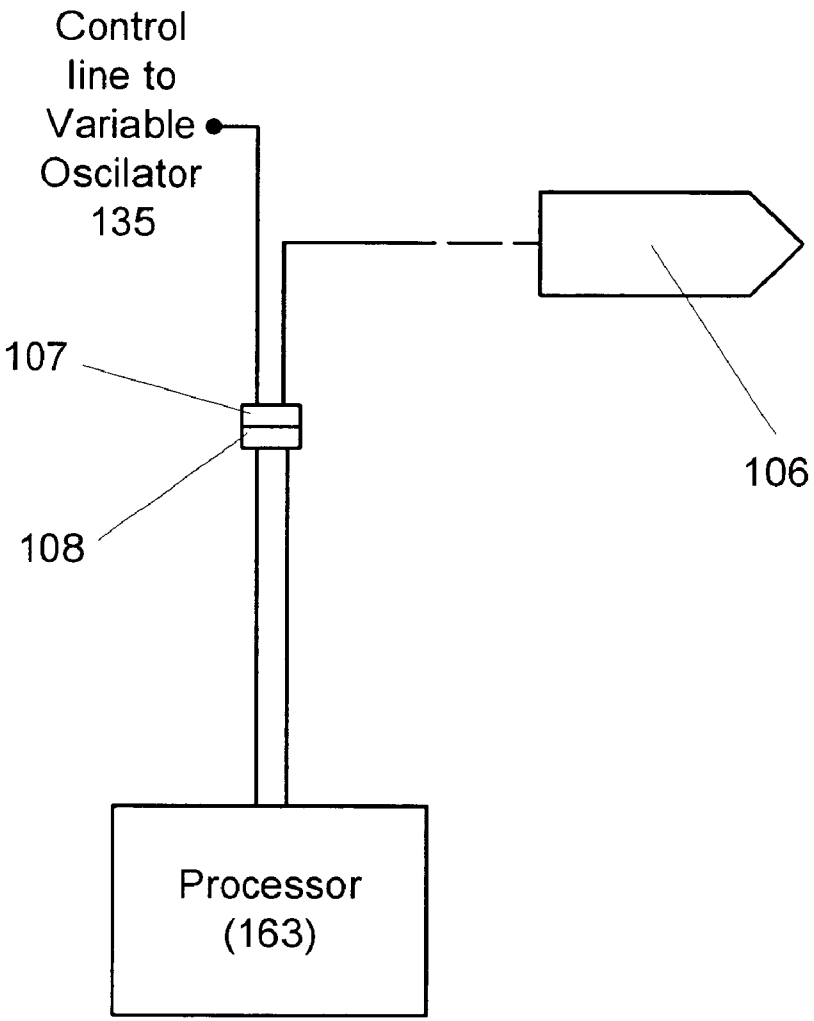
FIG. 3 is an illustration of a sonic signal detection system from the system illustrated in FIG. 1

The second electrode (108) provides a connection (109) to the supporting electronics of the print medium measuring system that are housed in the printer (100). These electronics (e.g., processor 163; FIG. 3) will be explained in detail below.

When the oscillator (103) drives the speaker (104) at the resonance frequency of the resonance chamber (105), the transducer (106) will detect an amplitude peak in the sound wave in the resonance chamber (105). The frequency of the oscillator (103) is then natural resonance frequency of the resonance chamber. The determined natural resonance frequency of the resonance chamber can then be used to determine the length of the print medium (102) on the resonance chamber (105). This will be explained in more detail below in connection with FIG. 3.

Figure 2:
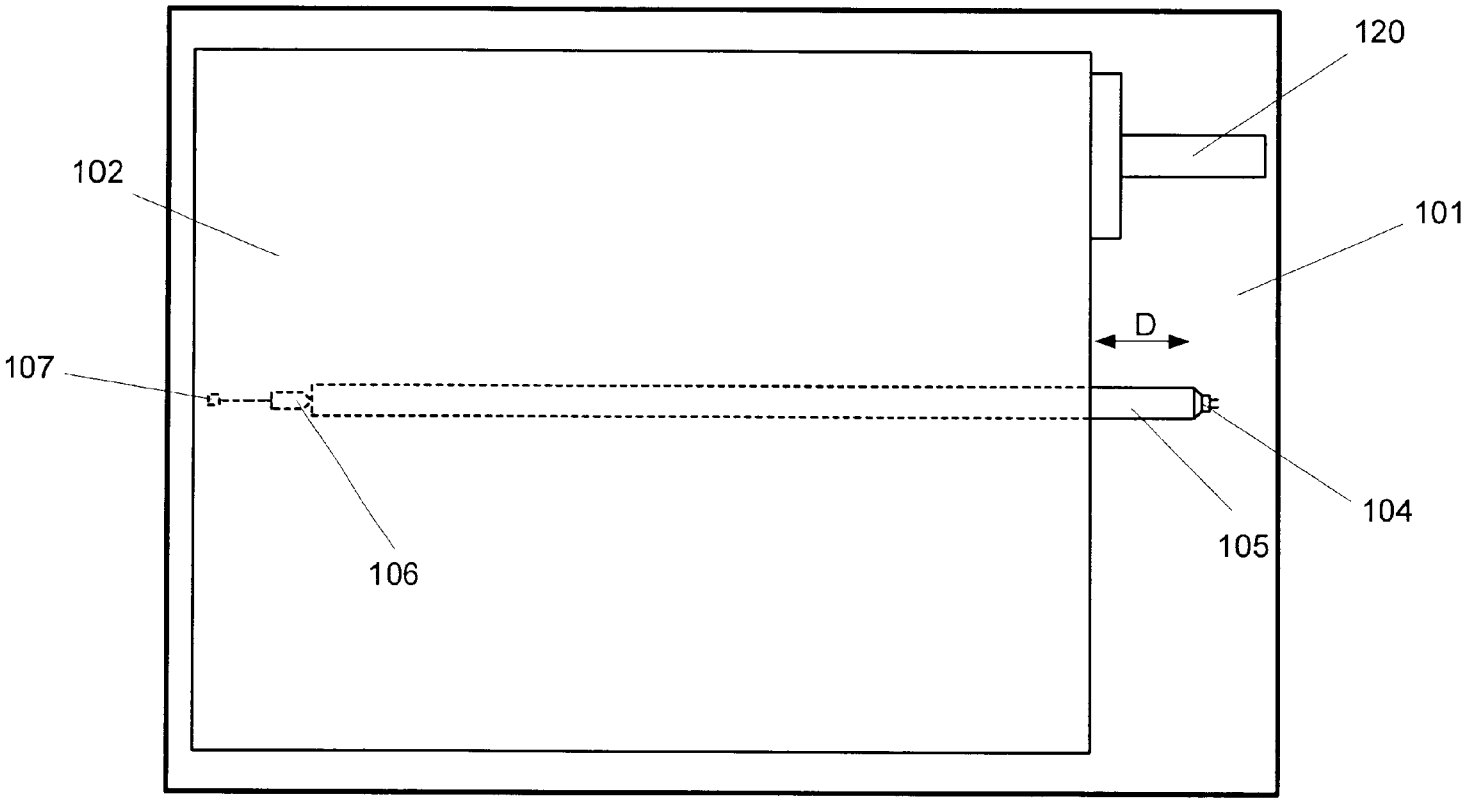
FIG. 2 is an illustration of a print medium supply tray from the system illustrated in FIG. 1.

FIG. 2 is a plan view of the print medium supply tray (101) illustrated in FIG. 1. As shown in FIG. 2, the tray (101) contains a supply of print medium (102), e.g., paper. In the bottom of the tray (101) is the resonance chamber (105). FIG. 2 also illustrates the speaker (104) and the transducer (106). The transducer (106) and the portion of the resonance chamber (105) covered by the print medium (102) are shown in ghost.

The resonance chamber (105) runs length-wise with regard to the supply of print medium (102) and is covered, except for the distance (D), by the print medium (102). Consequently, this resonance chamber (105) can be used as described above to measure the length of the print medium. To measure the width of the print medium, a second resonance chamber could be provided perpendicular to the chamber (105) already illustrated and operated on the same principles.

The resonance chamber (105) shown is illustrated as running roughly down the center of the tray (101). However, this is not required. The chamber (105) can be moved to either side so long as it runs length-wise with the print medium (102).

As is typical in print medium supply trays, the tray (101) may include one or more adjustable stops (120). Such stops (e.g., 120) can be adjusted to accommodate different sizes of print medium and serve to hold the supply of print medium (102) in a neat stack.

FIG. 3 illustrates in more detail a preferred embodiment of an audio signal detection system according to the principles of the present invention. As shown in FIG. 3, and as described above, the transducer (106) outputs a signal indicating the amplitude of sound waves in the resonance chamber. This signal is provided to a processor (163).

As shown in FIG. 3, the connection between the transducer (106), in the supply tray (101; FIG. 1), and the processor (163), in the printing device (100; FIG. 1), can be through an electrical connection (107, 108) between the supply tray and the feeder that houses the tray. Alternatively, as will be discussed below, the transducer (106) may be located in the feeder thereby obviating the need for an electrical connection between the tray and the feeder.

The processor (163) also controls the frequency output of the variable oscillator through a control line (135). In the embodiment of FIG. 3, this control line (135) may pass through the same interface (107, 108) as the connection between the processor (163) and the transducer (106).

Because the processor (163) controls the oscillator (103; FIG. 1), the processor (163) will contain data indicating the frequency at which the oscillator (103; FIG. 1) is driving the speaker (104; FIG. 1). When the transducer (106) signals an amplitude peak to the processor (163), the processor (163) will determine that the frequency at which the oscillator (103; FIG. 1) is then driving the speaker (104; FIG. 1) is the natural resonance frequency of the resonance chamber (105; FIG. 1). The processor (163) can then determine the length (or width) of the print medium (102; FIG. 1) using the predetermined relationship between the length of the print medium (102; FIG. 1) and the natural resonance frequency of the resonance chamber (105; FIG. 1). This relationship could be a look-up table, but is preferably a formula relating natural resonance frequency to print medium (102; FIG. 1) dimension.

Figure 4:
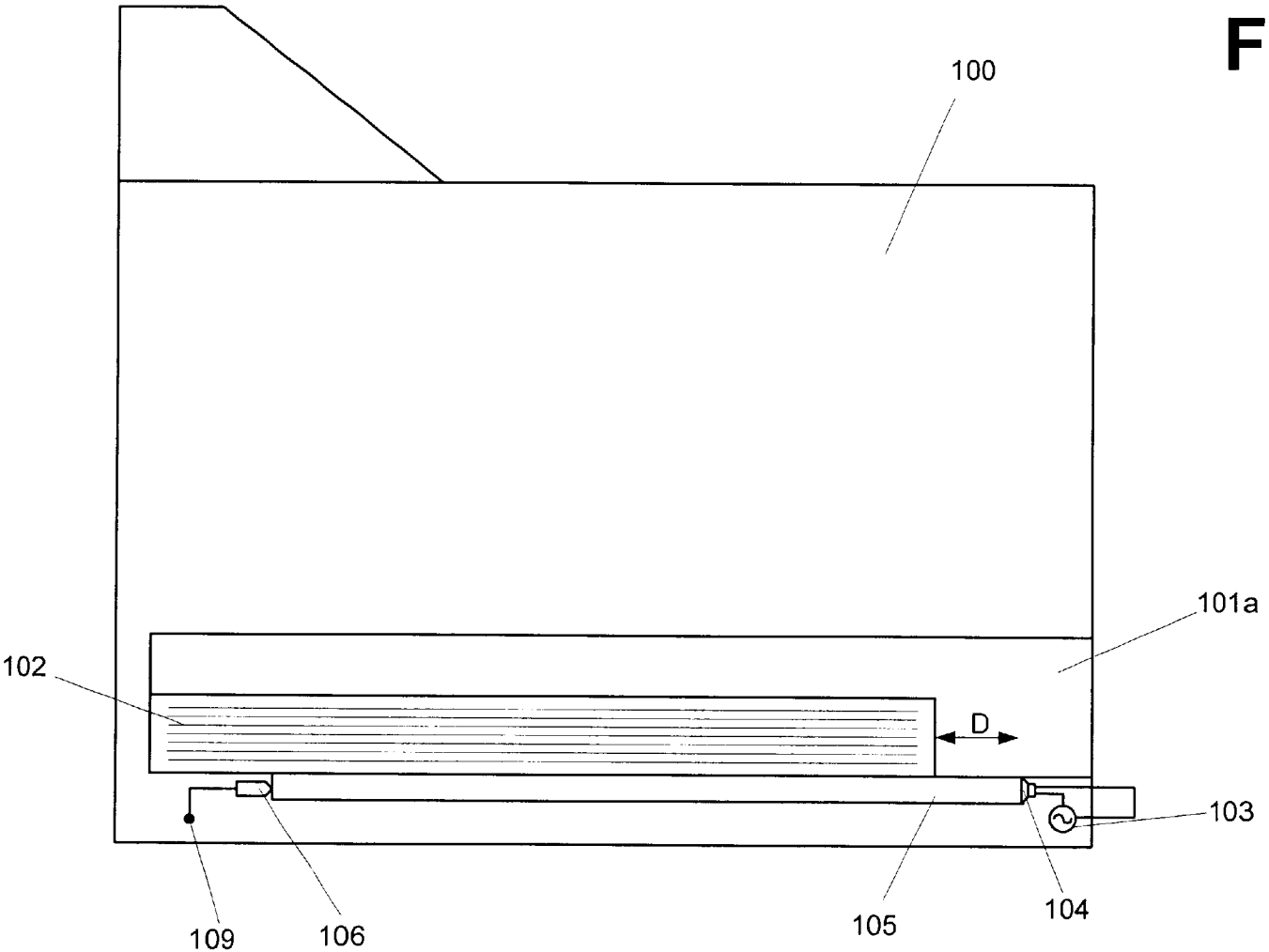
FIG. 4 is an illustration of a second preferred embodiment of a printer with a print medium size detection system according to the principles of the present invention.

FIG. 4 illustrates a second preferred embodiment of a printer (100) with an automatic print medium size detection system according to the principles of the present invention. As before, while a generic printer (100) is illustrated, it will be understood that the principles of the invention explained with regard to FIG. 4 could, with equal ease, be incorporated in any type of printing device that uses a supply of print medium (102) to output documents in hard copy form.

The principle difference between the embodiment in FIG. 1 and that in FIG. 4 is the location of the resonance chamber (105). In FIG. 1, the resonance chamber (105; FIG. 1) was illustrated as being in the bottom of the print medium supply tray (101; FIG. 1). In the embodiment of FIG. 4, the resonance chamber (105) is in the feeder area of the printer (100) and not in a removable supply tray (101*a*).

In fact, no supply tray (101*a*) need be used in this embodiment at all. Rather, the print medium (102) can simply be stacked in a supply area defined in the feeder over the resonance chamber (105) in the bottom of the feeder.

Alternatively, the embodiment shown in FIG. 4 can include the use of a supply tray (101*a*). This tray will be described in greater detail in FIG. 5.

Figure 5:
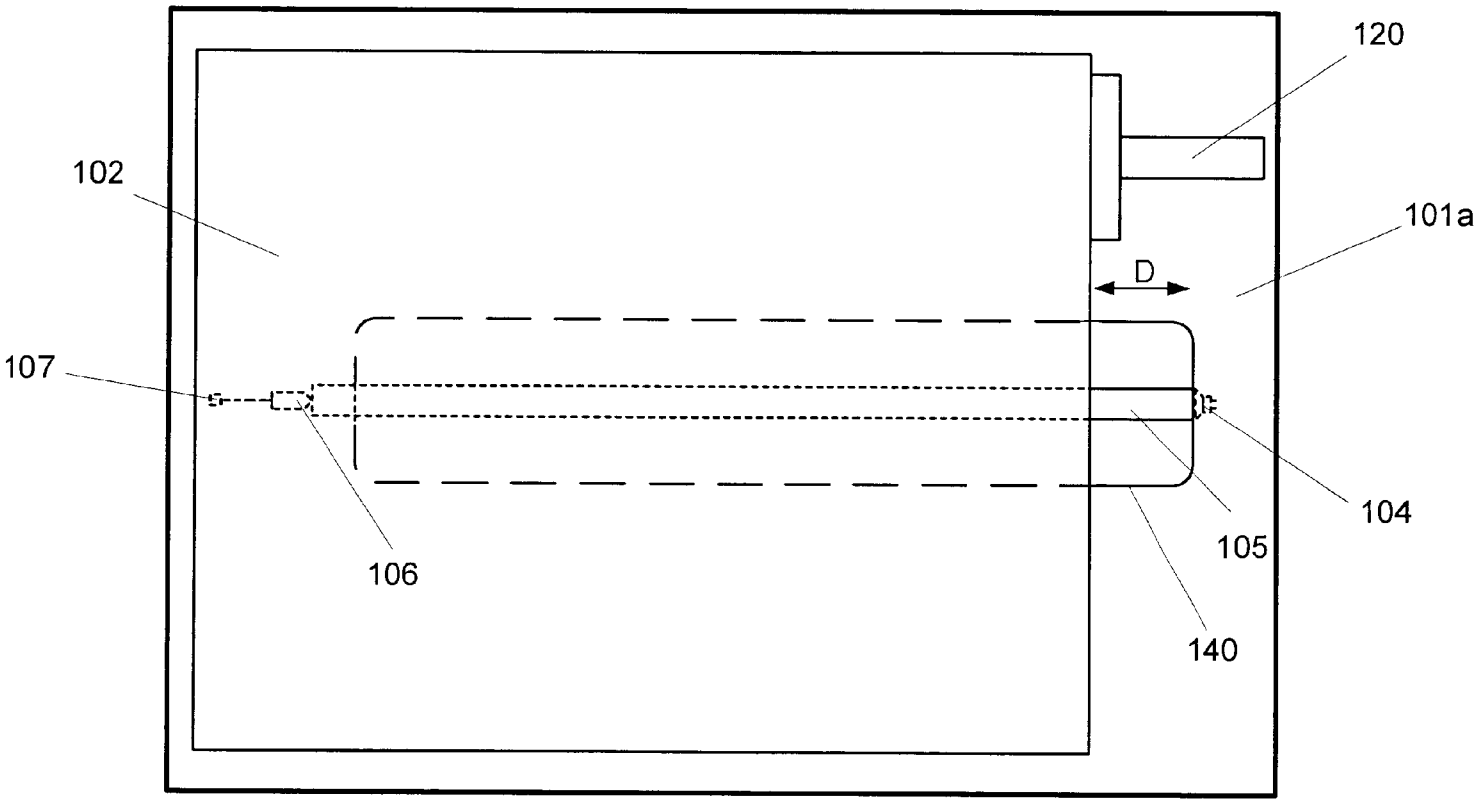
FIG. 5 is an illustration of a print medium supply tray from the system illustrated in FIG. 4.

FIG. 5 is a plan view of a print medium supply tray (101*a*) that can be used with the printer or printing device illustrated in FIG. 4 according to the present invention. As shown in FIG. 5, the tray (101*a*) holds a supply of print medium (102). One or more adjustable stops (e.g., 120) may be included in the tray for holding the print medium (102) in a neat stack.

The resonance chamber (105), speaker (104) and transducer (106) are illustrated in FIG. 5. However, in this embodiment, these elements are not in the supply tray (101*a*), but built into the bottom of the feeder area of the printer. A window (140) is provided in the bottom of the tray (101*a*) exposing the resonance chamber (105). Consequently, as in previous embodiment, an length of the resonance chamber (105), denoted by arrow "D," will be open through the window (140) in the supply tray (101*a*) and not covered by the print medium supply (102).

In this way, the length of the print medium can be measured in the same manner as described above by determining the natural resonance frequency of the resonance chamber (105) and correlating that frequency with the amount of the resonance chamber (105) covered by print medium (102) or the length of the print medium (102). Because the resonance chamber (105), speaker (104) and transducer (106) are all in the feeder of the printer and not in the tray (101*a*), there is no need for any electrical connection between the tray (101*a*) and the supporting electronics of the print medium measuring system (e.g., processor 163; FIG. 3).

Figure 6:
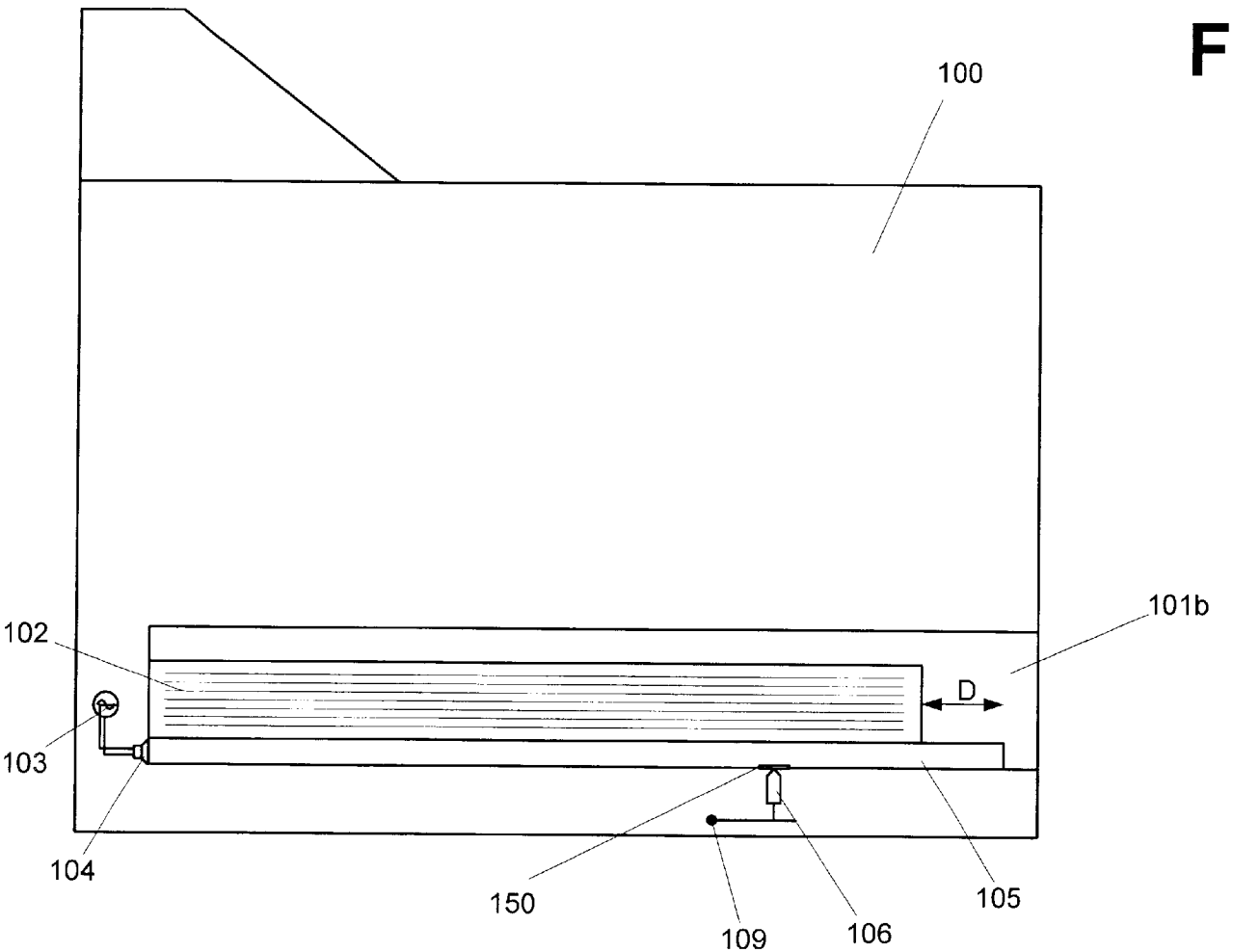
FIG. 6 is an illustration of a third preferred embodiment of a printer with a print medium size detection system according to the principles of the present invention.

FIG. 6 illustrates still another possible embodiment of a print medium measuring system according to the present invention. In this embodiment, the resonance chamber (105) is again provided in the bottom of a print medium supply tray (101*b*). However, the speaker (104), oscillator (103) and transducer (106) are located in the feeder area of the printer (100).

The resonance chamber (105) in this embodiment is open at the far end (left-hand side of FIG. 6). Consequently, when the supply tray (101*b*), including the resonance chamber (105), is inserted into the feeder area of the printer (100), the open end of the resonance chamber (105) is aligned with the speaker (104) so that the speaker (104) is operatively coupled to the resonance chamber (105) and can acoustically drive the chamber (105).

Another opening (150) in the tray (101*b*) provides access to the resonance chamber (105) for the transducer (106) so that the transducer (106) can perform its function of measuring the amplitude of the sound waves excited in the resonance chamber (105) by the speaker (104). The location of this opening (150) and the transducer (106) with respect to the resonance chamber (105) is not critical.

This embodiment again provides the advantage of requiring no electrical connection between the tray (101*b*) and the supporting electronics in the printer (e.g., processor 163; FIG. 3).

Figure 7:
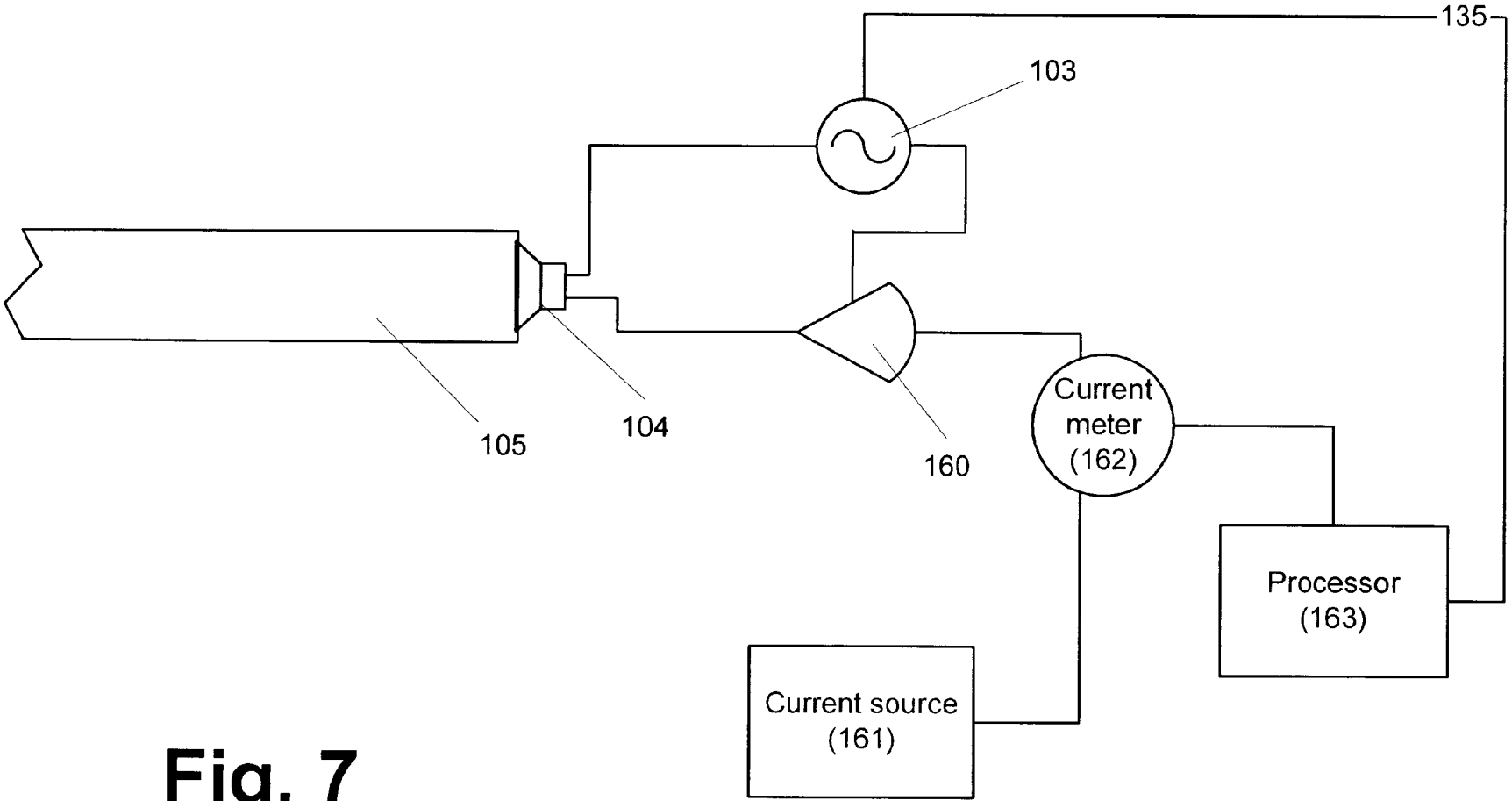
FIG. 7 is an illustration of a sonic signal emitter system from the system illustrated in FIG. 6.

FIG. 7 illustrates further principles of the present invention, which can be used to modify any of the foregoing embodiments so that the transducer may be omitted from that embodiment. FIG. 7 illustrates supporting electronics connected to the speaker (104) that is exciting a resonance chamber (105). As shown in FIG. 7, the signal from the variable oscillator (103) is fed through an amplifier (160) before being used to drive the speaker (104).

Such an amplifier (160) may be used in any of the foregoing embodiment to enhance the signal from the variable oscillator (103) to the speaker (104). However, in the embodiment of FIG. 7, the amplifier (160) operates by drawing current from a current source (161). The amount of current drawn by the amp (160) is measured by a current meter (162).

As described above, the processor (163) controls the variable oscillator (103) to try a range of frequencies until the natural resonance frequency of the resonance chamber (105) is found. A control line (135) connects the processor (163) to the oscillator (103). The processor (163) also receives output from the current meter (162) indicating the amount of current the amp (160) is drawing.

When the acoustic system comprised of the resonance chamber (105) and the speaker (104) is driven at the natural resonance frequency of the system, it will require very little energy to drive the system at that frequency. Consequently, when the variable oscillator (103) drives the speaker (104) at the natural resonance frequency of the resonance chamber (105), the amount of current required and drawn by the amp (160) will hit a minimum or trough.

Thus, when the current meter (162) signals to the processor (163) a drop in the current being pulled by the amp (160) to a minimum, the processor (163) can identify the frequency at which the oscillator (103) is then operating as the resonance frequency of the chamber (105). Because the processor (163) controls the oscillator (103), the processor (163) will always have data indicating the frequency at which the oscillator (103) is operating.

When the natural resonance frequency of the chamber (105), as partially covered by a supply of print medium (102; FIG. 1), is determined, the size of the print medium (102; FIG. 1) can then be determined according to the principles described above. However, as indicated above, the system illustrated in FIG. 7 can operate without requiring a microphone or other transducer (106; FIG. 1) for measuring the amplitude of the sound waves in the resonance chamber (105).

The preceding description has been presented only to illustrate and describe the invention. It is not intended to be exhaustive or to limit the invention to any precise form disclosed. Many modifications and variations are possible in light of the above teaching.

The preferred embodiment was chosen and described in order to best explain the principles of the invention and its practical application. The preceding description is intended to enable others skilled in the art to best utilize the invention in various embodiments and with various modifications as are suited to the particular use contemplated. It is intended that the scope of the invention be defined by the following claims.

What is claimed is:

1. A system for automatically sensing a size of print medium available to a printing device, said system comprising:

a resonance chamber, a portion of which is open, wherein said open portion is partially covered by a supply of print medium;

a sound emitting system for acoustically exciting said resonance chamber over a range of frequencies;

a system for detecting a natural resonance frequency of said resonance chamber as partially covered by said supply of print medium; and a processor for determining a dimension of said print medium based on a relationship between said natural resonance frequency of said resonance chamber and said dimension of said print medium.

2. The system of claim 1, wherein said sound emitting system further comprises:

a speaker; and a variable oscillator driving said speaker over said range of frequencies.

3. The system of claim 2, wherein said sound emitting system further comprises:

an amplifier for amplifying a signal from said variable oscillator to said speaker; and a current supply for supplying current to said amplifier.

4. The system of claim 3, wherein said system for detecting the natural resonance frequency of said resonance chamber further comprises a current meter for monitoring an amount of current pulled from said current supply by said amplifier as said variable oscillator drives said speaker over said range of frequencies.

5. The system of claim 4, wherein said system for detecting the natural resonance frequency of said resonance chamber further comprises said processor which:

controls said oscillator to drive said speaker over said range of frequencies;

receives an output signal from said current meter; and identifies the natural resonance frequency of said resonance chamber as a frequency at which said current meter signals a minimum of current being drawn by said amplifier.

6. The system of claim 2, wherein said system for detecting the natural resonance frequency of said resonance chamber further comprises a transducer for monitoring an amplitude of sound waves excited in said resonance chamber by said sound emitting system, wherein:

said processor controls said oscillator to drive said speaker over said range of frequencies;

said transducer sends an output signal to said processor that indicates to said processor when said amplitude reaches a peak; and said processor identifies the natural resonance frequency of said resonance chamber as a frequency at which said transducer signals said peak amplitude.

7. A method for automatically sensing a size of print medium available to a printing device with a resonance chamber which is open on a side that is partially covered by a supply of said print medium, said method comprising:

detecting a natural resonance frequency of said resonance chamber as partially covered by said supply of print medium; and determining a dimension of said print medium based on a relationship between said natural resonance frequency of said resonance chamber and said dimension of said print medium.

8. The method of claim 7, wherein said detecting said natural resonance frequency further comprises acoustically exciting said resonance chamber over a range of input frequencies.

9. The method of claim 8, wherein said detecting said natural resonance frequency further comprises monitoring an amplitude of sound waves excited in said resonance chamber to identify an input frequency resulting in sound waves with a maximum amplitude.

10. The method of claim 8, wherein said detecting said natural resonance frequency further comprises monitoring current drawn by an acoustic system acoustically exciting said resonance chamber to identify an input frequency with a minimum current requirement.

11. A printing device comprises a system for automatically sensing a size of print medium available to said printing device, said system comprising:

a resonance chamber, a portion of which is open, said resonance chamber being located so as to be partially covered by a supply of print medium when print medium is supplied to said printing device;

a sound emitting system for acoustically exciting said resonance chamber over a range of frequencies;

a system for detecting a natural resonance frequency of said resonance chamber as partially covered by said supply of print medium; and a processor for determining a dimension of said print medium based on a relationship between said natural resonance frequency of said resonance chamber and said dimension of said print medium.

12. The printing device of claim 11, wherein said sound emitting system further comprises:

a speaker; and a variable oscillator driving said speaker over said range of frequencies.

13. The printing device of claim 12, wherein said sound emitting system further comprises:

an amplifier for amplifying a signal from said variable oscillator to said speaker; and a current supply for supplying current to said amplifier.

14. The printing device of claim 13, wherein said system for detecting the natural resonance frequency of said resonance chamber further comprises a current meter for monitoring an amount of current pulled from said current supply by said amplifier as said variable oscillator drives said speaker over said range of frequencies.

15. The printing device of claim 14, wherein said system for detecting the natural resonance frequency of said resonance chamber further comprises said processor which:

controls said oscillator to drive said speaker over said range of frequencies;

receives an output signal from said current meter; and identifies the natural resonance frequency of said resonance chamber as a frequency at which said current meter signals a minimum of current being drawn by said amplifier.

16. The printing device of claim 12, wherein said system for detecting the natural resonance frequency of said resonance chamber further comprises a transducer for monitoring an amplitude of sound waves excited in said resonance chamber by said sound emitting system, wherein:

said processor controls said oscillator to drive said speaker over said range of frequencies;

said transducer sends an output signal to said processor that indicates to said processor when said amplitude reaches a peak; and said processor identifies the natural resonance frequency of said resonance chamber as a frequency at which said transducer signals said peak amplitude.

17. The printing device of claim 11, further comprising a supply tray for holding said supply of print medium.

18. The printing device of claim 17, wherein said resonance chamber is formed in said supply tray.

19. The printing device of claim 18, further comprising an electrical interface between said supply tray and said printing device, wherein electrical components of either said sound emitting system or said system for detecting the natural frequency of said resonance chamber are also disposed in said supply tray.

20. The printing device of claim 11, wherein said resonance chamber is formed in feeder area of said printing device.

21. The printing device of claim 20, further comprising a supply tray for holding said supply of print medium, said supply tray having a window in a bottom thereof allowing said supply of print medium to partially cover said resonance chamber which is formed in said feeder area of said printing device below said supply tray.

22. The printing device of claim 11, wherein said printing device is a printer.

23. The printing device of claim 11, wherein said printing device is a copier.

24. The printing device of claim 11, wherein said printing device is a facsimile machine.

* * * * *